US010240435B2

(12) United States Patent
Snyder et al.

(10) Patent No.: US 10,240,435 B2
(45) Date of Patent: Mar. 26, 2019

(54) ELECTRICAL GENERATOR AND ELECTRIC MOTOR FOR DOWNHOLE DRILLING EQUIPMENT

(71) Applicant: HALLIBURTON ENERGY SERVICES, INC., Houston, TX (US)

(72) Inventors: John Kenneth Snyder, Spring, TX (US); Victor Gawski, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 147 days.

(21) Appl. No.: 14/780,435

(22) PCT Filed: Jun. 14, 2013

(86) PCT No.: PCT/US2013/045849

§ 371 (c)(1),
(2) Date: Sep. 25, 2015

(87) PCT Pub. No.: WO2014/182318

PCT Pub. Date: Nov. 13, 2014

(65) Prior Publication Data

US 2016/0053588 A1 Feb. 25, 2016

Related U.S. Application Data

(63) Continuation-in-part of application No. PCT/US2013/040076, filed on May 8, 2013.

(51) Int. Cl.
*E21B 41/00* (2006.01)
*E21B 4/04* (2006.01)

(52) U.S. Cl.
CPC ..... *E21B 41/0085* (2013.01); *E21B 4/04* (2013.01)

(58) Field of Classification Search
CPC ..... E21B 41/0085; E21B 4/04
See application file for complete search history.

(56) References Cited

U.S. PATENT DOCUMENTS 2,161,374 A * 6/1939 Moineau ..... F04C 2/1075 290/52
2,531,958 A 11/1950 Williams, Jr. et al.
(Continued)

FOREIGN PATENT DOCUMENTS

WO WO2004004099 A1 1/2004

OTHER PUBLICATIONS

Authorized Officer Lee, Jong Kyung, International Search Report and Written Opinion in International Application No. PCT/US2013/040076, 12 pages.

(Continued)

*Primary Examiner* — Matthew R Buck
*Assistant Examiner* — Aaron L Lembo
(74) *Attorney, Agent, or Firm* — Alan Bryson; Parker Justiss, P.C.

(57) ABSTRACT

An electrical generator positionable downhole in a well bore includes a tubular housing having a first longitudinal end and a second longitudinal end, the housing having an internal passageway with a plurality of layers. The layers comprise at least a first protective layer, a second protective layer, and an electrically conductive layer positioned between the first and second protective layers. The layers define an internal cavity. A shaft with magnetic inserts is movably positioned in the internal cavity. Electrical current is generated when the shaft is moved. Alternatively, the device may be supplied with electrical power and used as a downhole motor.

20 Claims, 9 Drawing Sheets

(56) References Cited

U.S. PATENT DOCUMENTS 3,857,776 A 12/1974 Titus et al.
4,370,576 A 1/1983 Foster, Jr. et al.
4,577,664 A 3/1986 Takahashi et al.
4,669,555 A 6/1987 Petree
4,758,132 A * 7/1988 Hartwig ..... F01C 1/16 310/67 R
4,914,433 A 4/1990 Galle
5,171,139 A 12/1992 Underwood et al.
5,350,958 A 9/1994 Ohnishi
5,465,789 A 11/1995 Evans
5,832,604 A 11/1998 Johnson et al.
5,965,964 A * 10/1999 Skinner ..... E21B 41/0085 310/12.04
6,037,767 A * 3/2000 Crescenzo ..... G01N 27/82 324/220
6,504,258 B2 * 1/2003 Schultz ..... E21B 28/00 290/1 R
6,515,592 B1 2/2003 Babour et al.
6,705,085 B1 3/2004 Braithwaite
6,763,887 B2 7/2004 Boyadjieff
6,799,632 B2 10/2004 Hall et al.
6,905,319 B2 6/2005 Guo
6,936,937 B2 * 8/2005 Tu ..... H01F 7/021 310/12.12
6,952,170 B2 10/2005 Aiello
7,002,261 B2 * 2/2006 Cousins ..... H02P 6/15 290/43
7,168,510 B2 1/2007 Boyle et al.
7,683,802 B2 3/2010 Madhavan et al.
7,989,971 B2 * 8/2011 Lemieux ..... H02K 35/02 290/1 R
8,322,447 B2 * 12/2012 Loretz ..... E21B 41/0085 166/154
8,426,988 B2 4/2013 Hay
8,604,634 B2 * 12/2013 Pabon ..... E21B 41/0085 166/65.1
8,674,526 B2 * 3/2014 Lemieux ..... H02K 35/02 290/1 R
8,688,224 B2 * 4/2014 Lemieux ..... A61N 1/3785 607/61
8,704,387 B2 * 4/2014 Lemieux ..... F03G 7/08 290/1 R
8,944,185 B2 * 2/2015 Scholz ..... H02K 49/106 166/66.5
9,080,391 B2 * 7/2015 Gawski ..... E21B 17/003
9,322,389 B2 * 4/2016 Tosi ..... F03B 13/02
2004/0004099 A1 1/2004 Crouch
2006/0086536 A1 4/2006 Boyle et al.
2006/0151179 A1 7/2006 Boyadjieff
2007/0079989 A1 4/2007 Bankston et al.
2008/0025859 A1 1/2008 Lee et al.
2008/0074083 A1 * 3/2008 Yarger ..... H01M 6/5033 320/137
2009/0152009 A1 6/2009 Slay et al.
2009/0169364 A1 7/2009 Downton
2009/0295253 A1 * 12/2009 Yarger ..... H02K 3/02 310/216.003
2011/0120725 A1 5/2011 Downton et al.
2012/0018227 A1 1/2012 Puzz et al.
2012/0024632 A1 2/2012 John
2013/0000991 A1 * 1/2013 Scholz ..... H02K 49/106 175/328
2013/0048384 A1 2/2013 Jarvis et al.
2015/0211332 A1 * 7/2015 Noske ..... E21B 34/08 166/66.5
2016/0208556 A1 * 7/2016 Gawski ..... E21B 4/02

OTHER PUBLICATIONS

Lawrence et al., "Intelligent Wired Drill Pipe System Provides Significant Improvements in Drilling Performance on Offshore Australia Development," OTC 20067, Offshore Technology Conference, Houston, Texas, May 4-7, 2009, 8 pages.
Wang et al., "The New, Downlink Drilling Control System™ that Changes Conventional Drilling Operations," AADE-03-NTCE-47, AADE Technical Conference, Houston, Texas, Apr. 1-3, 2003, 12 pages.
Dalton et al., "The Benefits of Real-Time DownHole Pressure and Tension Data with Wired Composite Tubing," paper 2002-220, presented at the Petroleum Society's Canadian International Petroleum Conference, Calgary, Alberta, Canada, Jun. 11-13, 2002, 14 pages.
Commissioner, Korean International Property Office, International Search Report and Written Opinion in International Application No. PCT/US2013/045849, 21 pages.
PCT International Preliminary Report on Patentability, PCT/US2013/040076, dated Nov. 19, 2015, 9 pages.
PCT International Preliminary Report on Patentability, PCT/US2013/045849, dated Nov. 19, 2015, 17 pages.

* cited by examiner 10
57
14
12
55
60
22
25
20
32
34
24
40
50

ELECTRICAL GENERATOR AND ELECTRIC MOTOR FOR DOWNHOLE DRILLING EQUIPMENT

CROSS-REFERENCE TO RELATED APPLICATION

This continuation-in-part application claims the benefit of PCT patent application no. PCT/US13/40076, entitled "Insulated Conductor for Downhole Drilling Equipment," filed on May 8, 2013.

TECHNICAL FIELD

The present disclosure relates to systems, assemblies, and methods for generating electrical current in downhole tools attached to a drill string.

BACKGROUND

Tubular drilling tools are used in the drilling of boreholes in the ground. These tools may comprise singular tubular housings or tubular housing assemblies which contain a plurality of internal components (e.g., progressing cavity drilling motors). The hydraulic energy of drilling fluids and the mechanical energy of drilling tubulars or downhole drilling tool internal components are inherently present downhole during the drilling process. This power can be harnessed to provide a downhole electrical power generation source.

DETAILED DESCRIPTION

Progressing cavity power units, such as those used in downhole drilling motors, and progressing cavity pumps, such as those used in downhole submersible pumps for oil production are frequently known as Moineau-type motors and pumps. In a Moineau-type motor, a stator is typically enclosed in an outer housing. The stator includes a central passageway with a collection of helical lobes positioned in the passageway. A helical rotor interacts with the helical stator to define a plurality of cavities radially and longitudinally in the passageway. When pressurized fluid is supplied to an upper end of the downhole Moineau-type motor, the rotor is rotated and the progression of the cavities between the helical rotor and the lobes of the helical stator transfer the fluid for the upper end to the lower end of the motor. The interaction of the rotor and stator is used to convert hydraulic energy to mechanical energy in the form of torque and rotation which can be delivered to a downhole tool string. A Moineau-type pump works as a reverse application of the technology used in a Moineau-type motor. In a Moineau-type pump, rotational energy and torque is supplied to the rotor and the rotor is turned. The interaction of the rotor and stator to form progressing cavities moves (e.g., pumps) the fluid from one end of the pump to the other end of the pump.

Figure 2A:
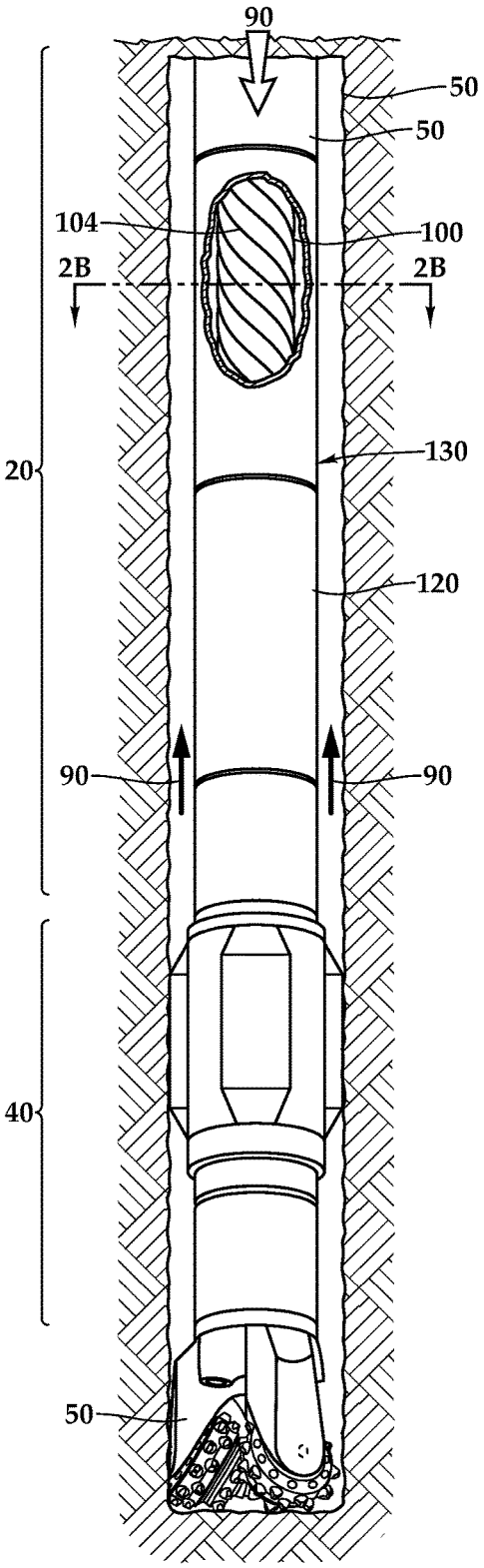
FIG. 2A illustrates a side view of an example downhole drilling assembly including a downhole drilling tool with portions of a tubular housing cut away for illustrating internal features of a downhole hydraulic drilling motor.
Figure 2B:
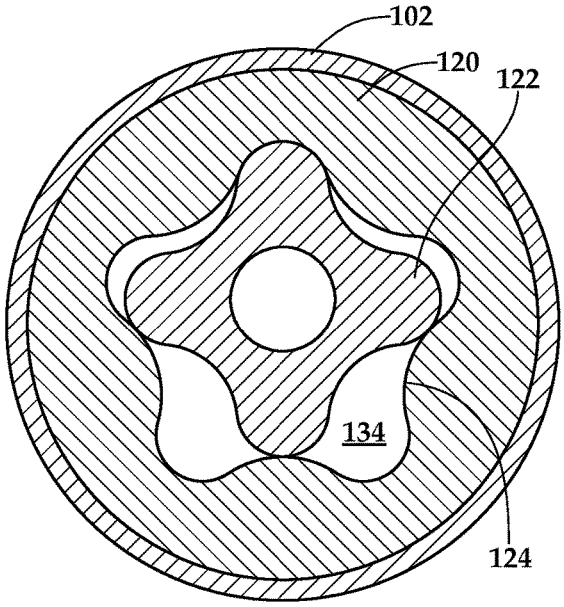
FIG. 2B is a cross-sectional view of a stator and rotor of a downhole drilling tool operatively positioned in a cavity defined by a stator positioned in the tubular housing.

FIG. 2A illustrates an example drilling assembly 50 positioned in the wellbore 60. In some implementations, the drilling assembly 50 can be the drill string 20. The distal end of the drilling assembly 50 includes the tool string 40 driven by a downhole motor 100 connected to the drill bit 50. The downhole motor 100 generally includes a tubular housing 102, which is typically formed of steel and encloses a power unit 104. The power unit 104 includes a stator 120 and a rotor 122. Referring to FIG. 2B, the stator 120 includes multiple (e.g., five) lobes. The rotor usually has one less lobe than the stator 124. As previously discussed above, the stator and rotor cooperate to define a plurality of progressing cavities 134. See exemplary configurations of rotors and stators in FIGS. 4A to 4F.

The rotor 122 is rotatably positioned in the cavity 134. The rotor 122 interacts with the helical stator 124 to define a plurality of cavities 134 radially and longitudinally in the passageway. When pressurized fluid is supplied to an upper end of the downhole Moineau-type motor, the rotor is rotated and the progression of the cavities between the helical rotor and the lobes of the helical stator transfer the fluid from the upper end to the lower end of the motor. The interactions of the rotor and stator are used to convert hydraulic energy to mechanical energy in the form of torque and rotation which can be delivered to a downhole tool string. For example, referring to FIGS. 2A and 2B, pressurized drilling fluid 90 (e.g., drilling mud) can be introduced at an upper end of the power unit 104 and forced down through the cavities 134. As a result of the pressurized drilling fluid 90 flowing through the cavities 134, the rotor 122 rotates which causes the drill bit 136 to rotate and cut away material from the formation. From the cavities 134, the drilling fluid 90 is expelled at the lower end and then subsequently exhausted from the motor then the drill bit 50.

During a drilling operation, the drilling fluid 90 is pumped down the interior of the drill string 20 (shown broken away) attached to downhole drilling motor 100. The drilling fluid 90 enters cavities 134 having a pressure that is imposed on the drilling fluid by pumps (e.g., pumps at the surface). As discussed above, the pressurized drilling fluid entering cavities 134, in cooperation with the geometry of the stator 120 and the rotor 122, causes the rotor 122 to turn to allow the drilling fluid 90 to pass through the motor 100. The drilling fluid 90 subsequently exits through ports (e.g., jets) in the drill bit 50 and travels upward through an annulus 130 between the drill string 20 and the wellbore 60 and is received at the surface where it is captured and pumped down the drill string 20 again.

Some conventional Moineau-type pumps and motors include stators that have stator contact surface formed of a rubber or polymer material bonded to the steel housing. However, in the dynamic loading conditions typically involved in downhole drilling applications, substantial heat can be generated in the stator and the rotor. Since rubber is generally not a good heat conductor, thermal energy is typically accumulated in the components that are made of rubber (e.g., the stator). This thermal energy accumulation can lead to thermal degradation and, therefore, can lead to damage of the rubber components and to separation of the rubber components.

Additionally, in some cases, the drilling fluid to be pumped through the motor is a material that includes hydrocarbons. For example, oil-based or diesel-based drilling fluids can be used which are known to typically deteriorate rubber. Such deterioration can be exacerbated by the accumulation of thermal energy. Water and water based fluids can present a problem for rubber components in drilling applications.

For optimum performance of the drilling motor, there is typically a certain required mating fit (e.g., clearance or interference) between the rubber parts of the stator and the rotor. When the rubber swells, not only the efficiency of the motor is affected but also the rubber is susceptible to damage because of reduced clearance or increased interference between the rotor and the stator. The reduced clearance typically induces higher loads on the rubber.

Contact between the stator and the rotor during use causes these components to wear (i.e., the rubber portion of the stator or the rotor), which results in the mating fit between the stator and the rotor to change. In some cases, the rotor or the stator can absorb components of the drilling fluid and swell, which can result in the clearance getting smaller, causing portions of the rotor or stator to wear and break off. This is generally known as chunking. In some cases, the chunking of the material can result in significant pressure loss so that the power unit is no longer able to produce suitable power levels to continue the drilling operation. Additionally or alternatively, in some cases, chemical components in the drilling fluid used can degrade the rotor or the stator and cause the mating fit between them to change. Since the efficient operation of the power unit typically depends on the desired mating fit (e.g., a small amount of clearance or interference), the stator and/or the rotor can be adjusted during equipment maintenance operations at surface to maintain the desired spacing as these components wear during use.

In some implementations, the tool string 40 includes electrical elements such as motors, actuators and sensors that are in electrical communication with electrical equipment 55 located at the surface 12. The previously discussed downhole conditions can be highly adverse to conventional electrical conductors, such as insulated wires, as such conductors may interfere with the mechanical operation of the drill string 20 or may be susceptible to breakage, corrosion, or other damage when exposed to the conditions experienced during drilling operations. In order to provide power to such electrical elements, the drill string 20 and/or elements of the tool string 40 include electrically conductive elements that will be discussed in the descriptions of FIGS. 3-11.

Figure 1:
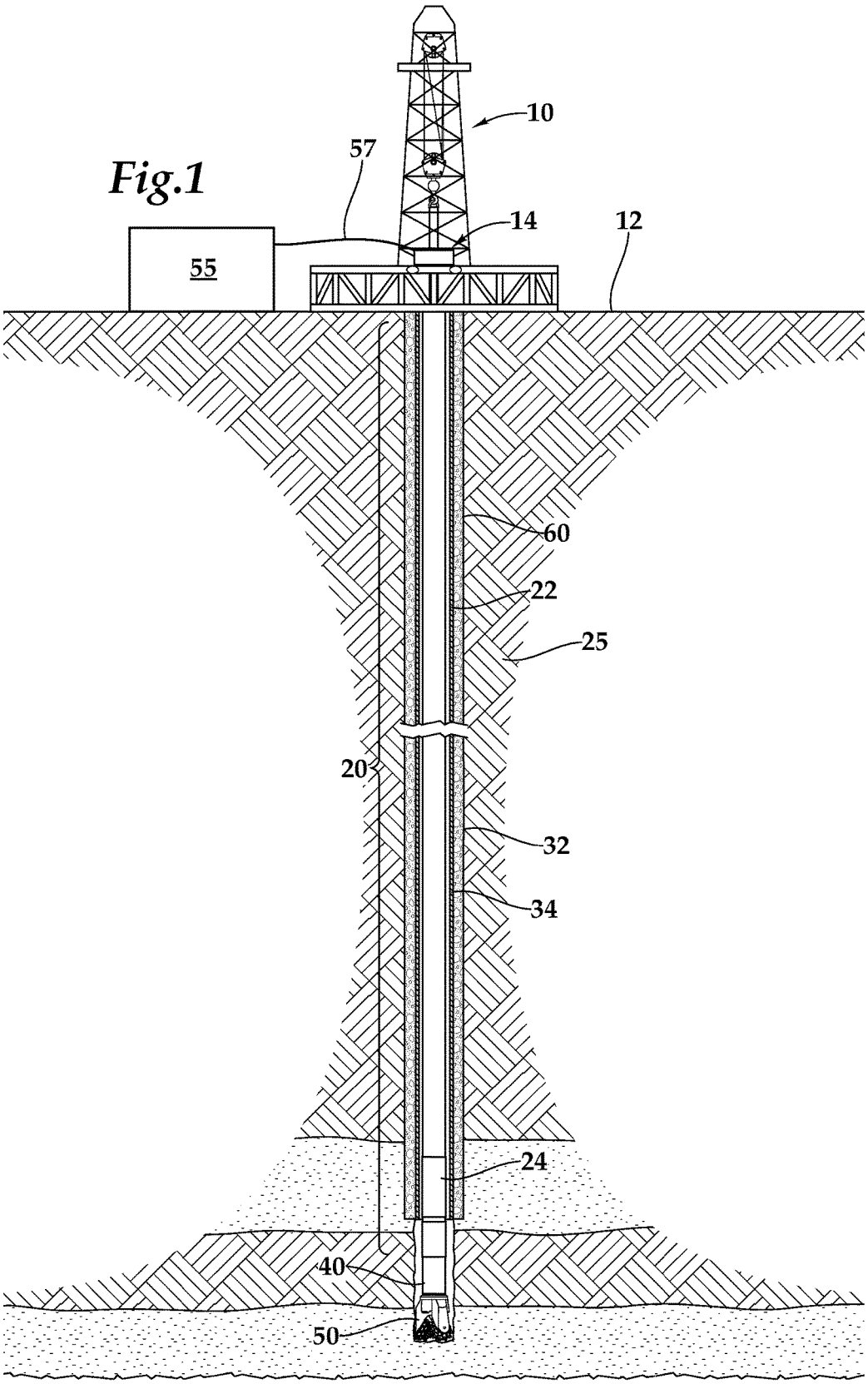
FIG. 1 is a schematic illustration of a drilling rig and downhole equipment positioned in a wellbore.
Figure 3A:
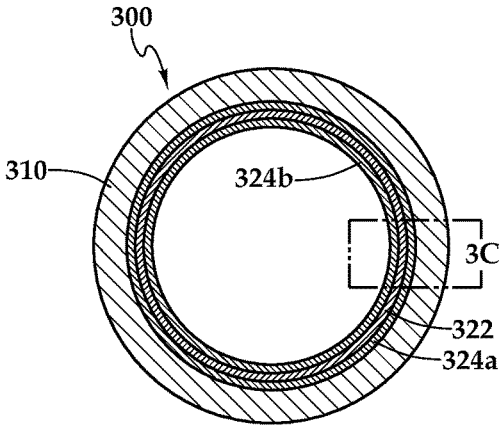
FIGS. 3A-3C are cross-sectional views of an example stator that includes an insulated conductor.
Figure 3C:
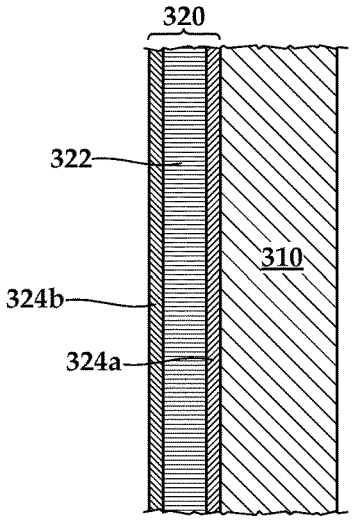
Figure 3B:
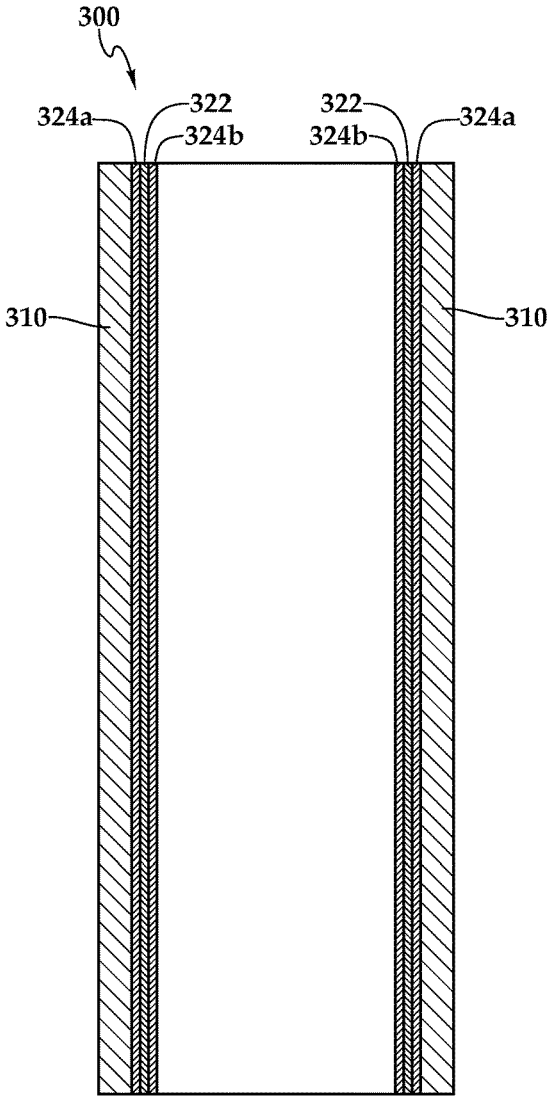

FIGS. 3A-3C are cross-sectional views of an example stator 300 of a downhole drilling tool (e.g., a downhole motor 300) that includes an insulated conductive layer 320. In some implementations, the stator 300 can be part of the drill string 20 of FIG. 1 or the stator 120 of FIGS. 2A-2B.

In some implementations the insulated conductors disclosed herein may be used to pass one or more electrical conductors through housings and around or through the bores of the drive shafts of other downhole drilling tools such as RSS steerable tools, turbines, anti-stall tools and downhole electric power generators. In other implementations, the insulated conductors may be passed through downhole reciprocating tools such as jars and anti-stall tools.

In general, when used with components such as the bores of downhole motor stator housings, the insulated conductive layer 320 can take the form of a circumferential layer, a semi-circumferential layer, a thin straight strip, a spiral strip, or any other appropriate conductive layer which is insulated, geometrically unobtrusive (e.g., thin in-wall section, with good adhesion), and does not negatively affect stator elastomer bonding or geometry integrity.

The stator 300 includes a tubular housing 310 which is typically formed of steel. The insulated conductive layer 320 is included substantially adjacent to an inner surface of the tubular housing 310. The insulated conductive layer 320 may be formed as a circumferential layer, a semi-circumferential layer, a thin straight strip, a spiral strip, or any other appropriate conductive layer. In some implementations, the insulated conductive layer 320 may conform to the geometry of the inner surface of the tubular housing 310.

Referring now to FIG. 3C, a section of the stator 300 is shown in greater detail. The insulated conductive layer 320 includes a conductive sub-layer 322, an insulating sub-layer **324*a*, and an insulating sub-layer 324*b*. The conductive sub-layer 322 is formed of an electrically conductive material that is molded, extruded, sprayed, or otherwise formed to substantially comply with the geometry of the inner surface of the tubular housing 310. The conductive sub-layers may be manufactured from various materials including metallics (e.g., copper) and from carbon nano tubes. The insulating sub-layers 324*a*, 324*b* provide electrical insulation between the conductive sub-layer 322 and other adjacent layers (e.g., the tubular housing 310) and/or from other conductive layers as will be discussed in the descriptions of FIGS. 4A-4B and 5. In some implementations, the insulating sub-layers 324*a*, 324*b* may be molded, sprayed, or otherwise formed to an electrically insulating sleeve substantially adjacent to the conductive sub-layer 322. In general, the conductive sub-layer 322 is sandwiched between the insulating sub-layer 324*a* and the insulating sub-layer 324*b*. The insulating sub-layers 324*a*, 324*b* may be applied to the full circular bore or the full outer surface of the tubular housing 310, or may be applied to discrete areas, with the conductive sub-layer 322 placed between the insulated areas. In some embodiments, the conductive sub-layer 322 can be formed or assembled as a series of insulated conductive rings or cylindrical sub-sections along the inner surface of the tubular housing 310**.

In some embodiments, the insulating sub-layer 324*b* can be a protective layer provided radially between the conductive sub-layer 322 and the bore of the tubular stator 300. The insulating sub-layers may be manufactured from various materials including polymers (including carbon nano tubes) and ceramics. The insulating sub-layer 324*b* can protect the conductive sub-layer 322 from the erosive and abrasive conditions that may be present within the bore, e.g., wear from contact with a rotor or shaft, wear and erosion from mud or other fluid flows, chemical degradation due to substances carried by drilling mud or fluid flows. In some embodiments, the insulating sub-layer 324*b* can be molded, sprayed, or otherwise take the form of a protective sleeve. In some embodiments, the insulating sub-layer 324*b* may implement nano-particle technology, and/or may be thin, e.g., a fraction of a millimeter, to several millimeters thick. In some embodiments, the insulating sub-layer 324*b* may provide anti-erosion, anti-abrasion properties, and/or electrical insulating properties.

In some implementations, the width, thickness, and material used as the conductive sub-layer 322 may be selected based on the amount of data or power that is expected to be transmitted through it. In some implementations, the conductive material, geometry, and/or location conductive sub-layer 322 may be selected to allow for the bending, compressing, and/or stretching of the drilling tubulars as is experienced in a downhole drilling environment.

Figure 3D:
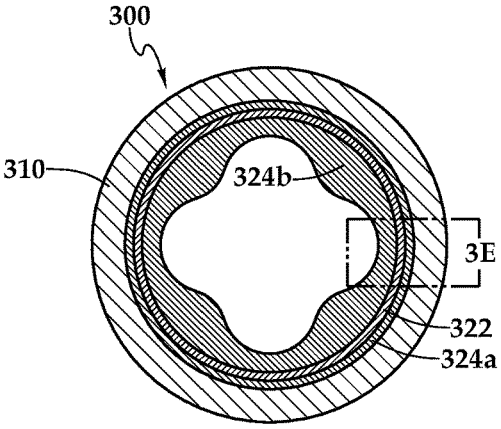
FIGS. 3D and 3E are cross-sectional views of another implementation of an example stator positioned in a tubular housing.
Figure 3E:
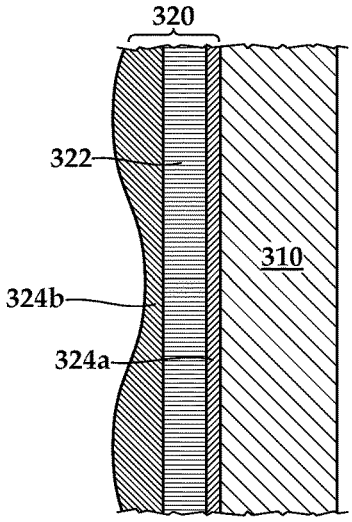

FIGS. 3D and 3E illustrate alternative stator geometry for the insulating sub-layer 324*b*.

Figure 4A:
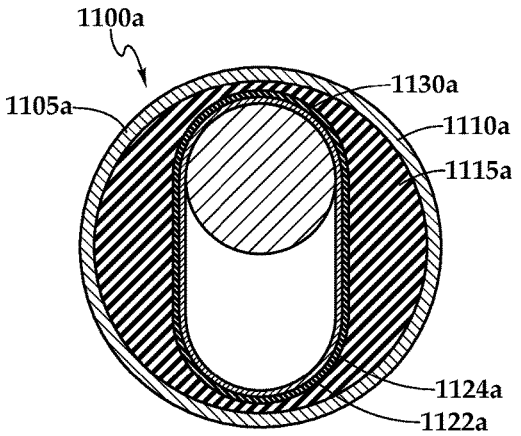
FIGS. 4A-4F illustrate example configurations of some implementations of stator and rotor lobes.
Figure 4B:
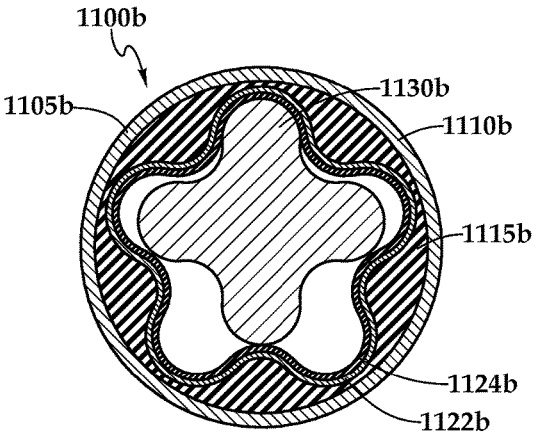
Figure 4C:
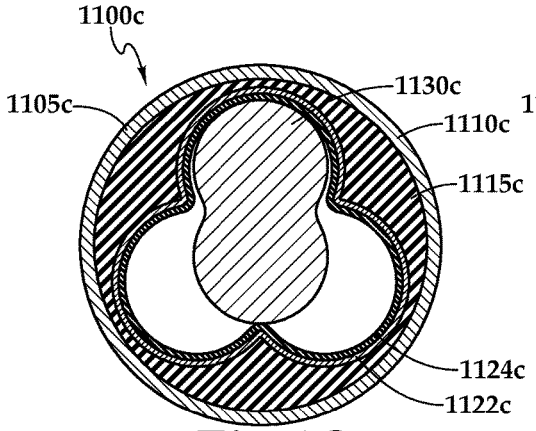
Figure 4D:
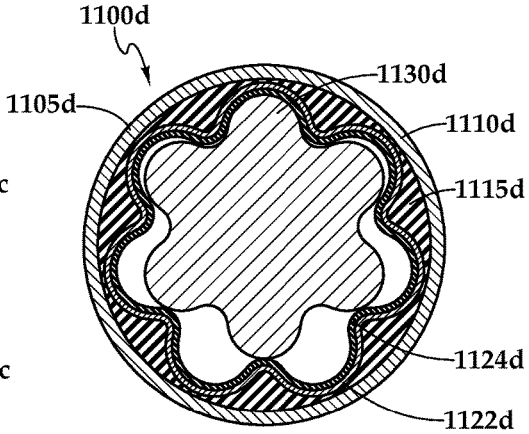
Figure 4E:
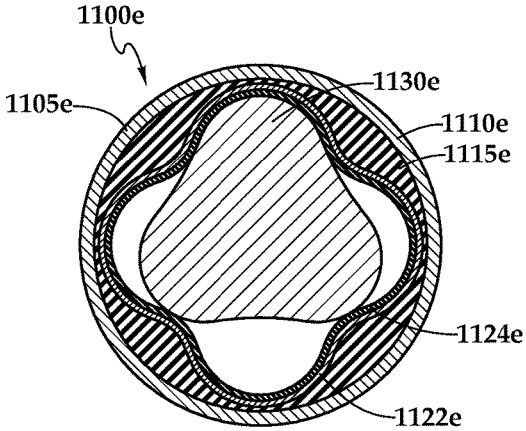
Figure 4F:
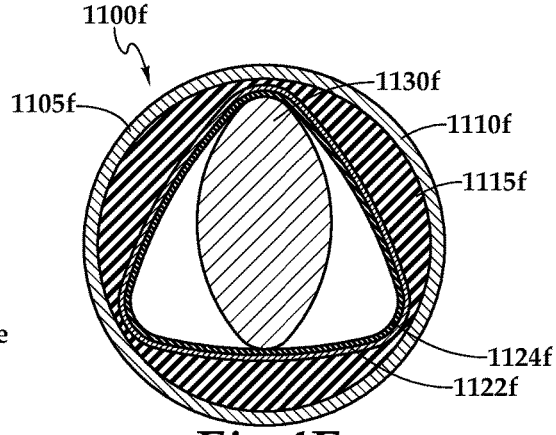

FIGS. 4A to 4F illustrate example configurations of additional example embodiments of stator and rotor lobes. FIG. 4A is a cross-sectional end view 1100*a* of an example stator 1105*a* that includes an example tubular housing 1110*a*, an example elastomer layer 1115*a*, an example conductive sub-layer 1122*a*, an example insulating layer 1124*a*, and an example rotor 1130*a*. FIG. 4B shows a cross-sectional end view 1100*b* of an example stator 1105*b* that includes an example tubular housing 1110*b*, an example elastomer layer 1115*b*, an example conductive sub-layer 1122*b*, an example insulating layer 1124*b*, and an example rotor 1130*b*. FIG. 4C shows a cross-sectional end view 1100*c* of an example stator 1105*c* that includes an example tubular housing 1110*c*, an example elastomer layer 1115*c*, an example conductive sub-layer 1122*c*, an example insulating layer 1124*c*, and an example rotor 1130*c*. FIG. 4D shows a cross-sectional end view 1100*d* of an example stator 1105*d* that includes an example tubular housing 1110*d*, an example elastomer layer 1115*d*, an example conductive sub-layer 1122*d*, an example insulating layer 1124*d*, and an example rotor 1130*d*. FIG. 4E shows a cross-sectional end view 1100*e* of an example stator 1105*e* that includes an example tubular housing 1110*e*, an example elastomer layer 1115*e*, an example conductive sub-layer 1122*e*, an example insulating layer 1124*e*, and an example rotor 1130*e*. FIG. 4F shows a cross-sectional end view 1100*f* of an example stator 1105*f* that includes an example tubular housing 1110*f*, an example elastomer layer 1115*f*, an example conductive sub-layer 1122*f*, an example insulating layer 1124*f*, and an example rotor 1130*f*.

Figure 5:
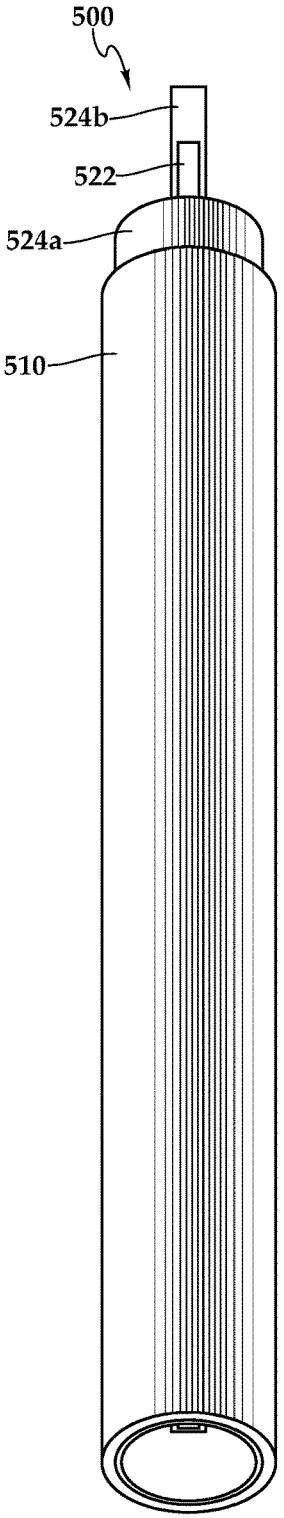
FIG. 5 is a cross-sectional view of another example stator that includes a substantially straight insulated conductive strip.

FIG. 5 is a view of another example stator 500 that includes a substantially straight insulated conductive strip. In the illustrated example, the stator 500 includes a tubular housing 510 and a conductive strip layer 522. Although one conductive strip layer is described in this example, in some embodiments, two, three, four, or any other appropriate number of conductive strip layers may be used.

The conductive strip layer 522 is arranged substantially parallel to the longitudinal geometry of the inner surface of the insulating sub-layer 524*a*. The conductive strip layer 522 is electrically insulated from the tubular housing 510 by the insulating sub-layer 524*a*, and is electrically insulated from the bore of the stator 500 by an insulating sub-layer 524*b*. The conductive strip layer may take a helical form in the bore of the housing or may be of other regular or irregular geometry.

Figure 6A:
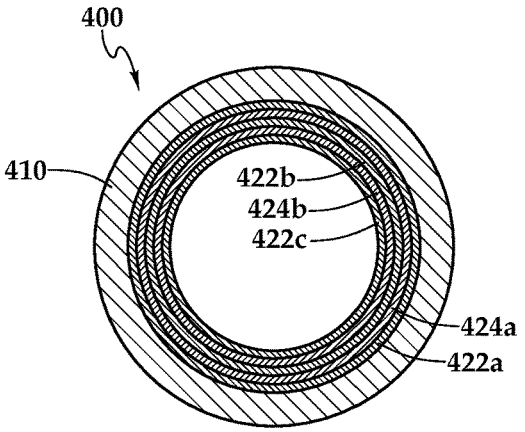
FIGS. 6A-6B are cross-sectional views of an example stator that includes multiple insulated conductors.
Figure 6B:
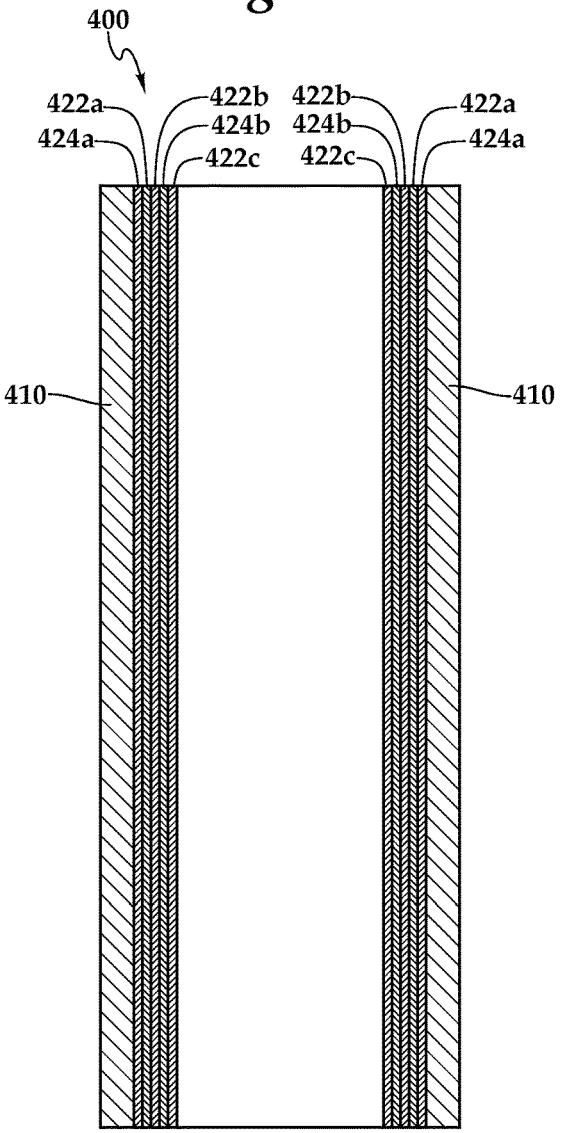

FIGS. 6A-6B are cross-sectional views of an example stator 400 that includes multiple insulated conductors. In the illustrated example, the stator 400 includes a tubular housing 410 and two conductive layers 422*a* and 422*b*. Although two conductive layers are described in this example, in some embodiments, three, four, or any other appropriate number of conductive layers may be used.

The conductive layers 422*a*-422*b* are concentric layers formed to substantially conform to the geometry of the inner surface of the tubular housing 410. The conductive layer 420*a* is separated from the tubular housing 410 by an insulating sub-layer 424*a*. The conductive layers 422*a*-422*b* are separated by the insulating sub-layers 424*b* of FIG. 3C, and the conductive layer 422*b* is electrically insulated from the bore of the stator 400 by an insulating sub-layer 424*c*.

Figure 7:
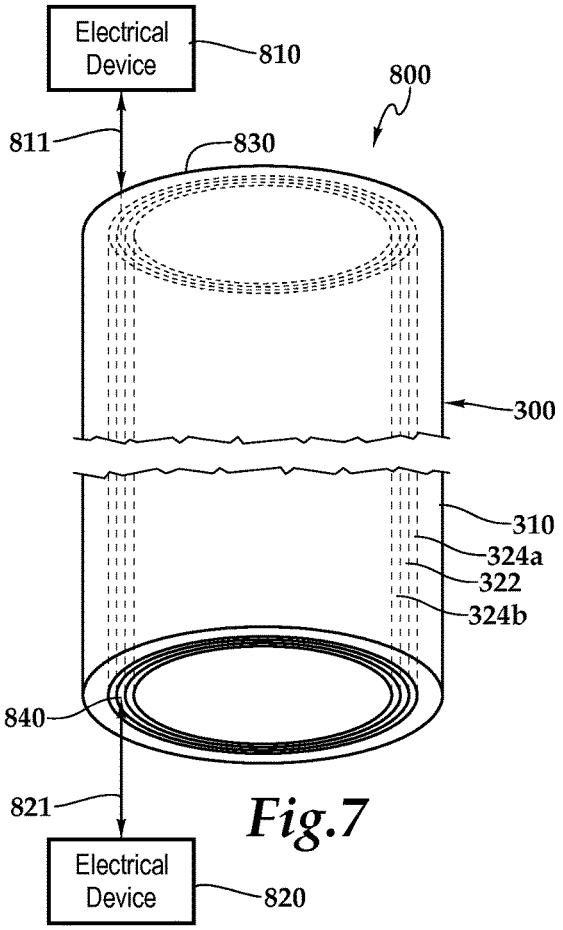
FIG. 7 illustrates a conceptual example implementation of a stator that includes an insulated conductor.

FIG. 7 illustrates a conceptual example implementation 800 of the example stator 300. In the illustrated example, a first electrical device (electrical power or data generator) 810 is electrically connected to a second electrical device (electrical power consumer or data receiver) 820 by the conductive sub-layer 322 of the stator 300. The first and second electrical devices 810, 820 may be, for example, an electricity generating dynamo and electro-mechanical actuator (e.g., a downhole drilling component such as an adjustable gauge stabilizer, traction device or a packer), or a digital data transmitter and digital data acquisition component. Each electrical device 810, 820 may include electronic components such as logic circuits, integrated circuits, and memory, optionally governed by firmware or other computer usable code for electronically controlling operation of the electrical devices 810, 820. The first electrical device 810 is connected to the conductive sub-layer 322 at a first end 830 of the stator 300, and the second electrical device 820 is connected to the conductive sub-layer 322 at a second end 840 of the stator 300. The conductive sub-layer 322 provides an electrical pathway between the first end 830 and the second end 840 of the stator 300, to facilitate electrical communication between the first electrical device 810 and the second electrical device 820. The insulating sub-layers 324*a*, 324*b* provide electrical insulation for the conductive sub-layer 322. In some implementations, the first electrical device 810 and/or the second electrical device 820 can be a source of electrical energy, a consumer of electrical energy, a passive or active component receiving an electrical signal (e.g., data signal), an electrical ground, or combinations of these and/or other appropriate electrical components. The electric current being conducted from electrical device 810 through a first electrical end conductor 811 to the conductive sub-layer 322 may include an electrical signal being transmitted and/or electrical power being conducted. For example, the first electrical device 810 can provide an electrical signal via a first end conductor 811 to the first end 830, and the signal can be transmitted along the conductive sub-layer 322 to the second end 840 or alternatively instead of a signal, electrical power may be conducted through the conductive sub-layer and used to power a device in the tool string. Electric current is received from the electrically conductive layer at a second end 840 and may be transmitted via a second end conductor 821. For example, the second electrical device 820 is connected via second end conductor 821 to the conductive sub-layer 322 to receive the signal that has been transmitted from the first electrical device 810 or alternatively receive the electrical power conducted through the conductive layer. It will be appreciated that a signal or power may be transmitted in either direction through the conductive layer. It will be appreciated that the electrical end conductor 811 and 821 may be any conductive device (e.g., a simple wire or a male/female type electrical coupler).

The implementation 800 can provide efficient and reliable electronic power and/or data transmission through downhole tools and/or drill strings. Power and/or data can be conducted through insulated conducting sleeves, e.g., the conductive sub-layer 322 and the insulating sub-layers 324*a*, 324*b*, which can form a solid part of drilling equipment cylindrical tubular components such as the stator 300. In some implementations, the stator 300 may provide electrical connectivity without significantly impacting the physical operational integrity of the drilling equipment components; e.g., the cross-sectional geometry of the stator 300 may not be significantly impacted by the inclusion of the conductive sub-layer 322 and the insulating sub-layers 324*a*, 324*b*. In some implementations, adverse drilling fluid erosion, corrosion, vibration, and/or shock loading effects on the conductor may be reduced. For example, the flow of fluid through the bore of the stator 300 may be substantially unaffected by the presence of the conductive sub-layer 322 and the insulating sub-layers 324*a*, 324*b*, since the bore of the stator 300 can be formed with an inner surface geometry that is similar to stators not having insulated conducting sleeves, such as the example drill string 20 of FIGS. 2A-2B.

Figure 8:
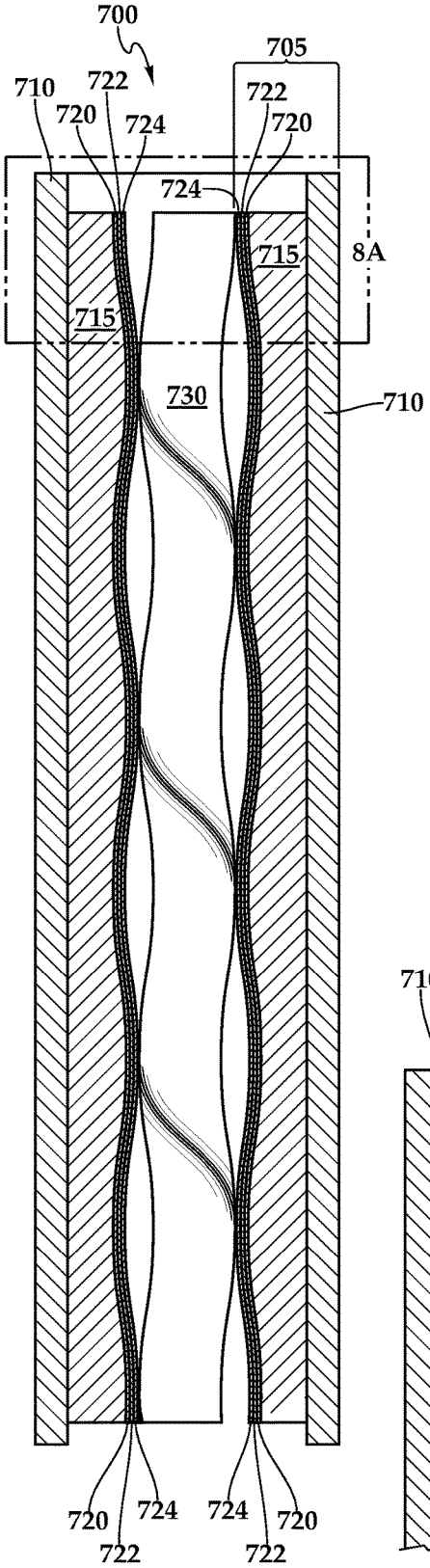
FIGS. 8 and 8A are cross-sectional side views of a stator and rotor of a downhole drilling motor.
Figure 8A:
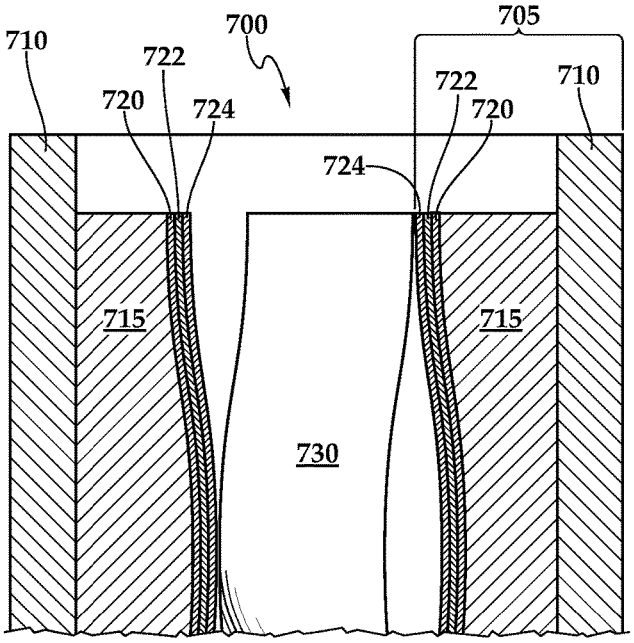

FIGS. 8 and 8A are cross-sectional side views of an example stator 705 and example rotor 730 of an example downhole drilling motor 700. The stator 705 includes a tubular housing 710 (e.g., metal housing). In some embodiments, an additional helically lobed metal insert 715 is inserted into housing 710 or a helical lobe form is produced directly on the bore of housing 710. Then an insulated layer 720 is first applied to the inner surface of insert 720 or alternatively to the bore of the housing 710, then the conductor layer 722 is applied and then the elastomer sub-layer 724 is applied. FIG. 8A is an enlarged portion of FIG. 8 and illustrates these applied layers.

The conductive sub-layer 722 is formed along the complex inner surface of the insulated layer 720 which is applied to the metal insert layer 715 (or alternatively the bore of the housing 210). In some embodiments, the conductive sub-layer 722 may be an electrically conductive sleeve or strip that is inserted or otherwise applied to the inner surface of the elastomer layer 715. In some embodiments, the conductive sub-layer 722 may be a fluid or particulate compound that is sprayed, coated, or otherwise deposited upon the inner surface of the metal insert layer 715.

The insulating sub-layer 724 is formed along the concentrically inward surface of the conductive sub-layer 722. The insulating sub-layer 724 may be polymeric and therefore deformable when the rotor is rotated inside the stator assembly. The insulating sub-layer 724 can protect the conductive sub-layer 722 from the erosive and abrasive conditions that may be present within the bore, e.g., wear from contact with the rotor 730, wear from mud or other fluid flows, chemical degradation due to substances carried by mud or fluid flows. In some embodiments, the insulating sub-layer 724 can be molded, sprayed, or otherwise take the form of a protective sleeve. In some embodiments, the insulating sub-layer 724 may implement nano-particle technology, and/or may be thin, e.g., a fraction of a millimeter to several millimeters thick. In some embodiments, the insulating sub-layer 724 may provide anti-erosion, anti-abrasion properties, and/or electrical insulating properties.

In some embodiments, the elastomer layer 720 applied to metal layer 715 can provide electrical insulation. For example, the elastomer layer 720 applied on metal layer 715 may also perform the function of an insulating sub-layer between the conductive sub-layer 722 and the tubular housing 710.

Figure 9A:
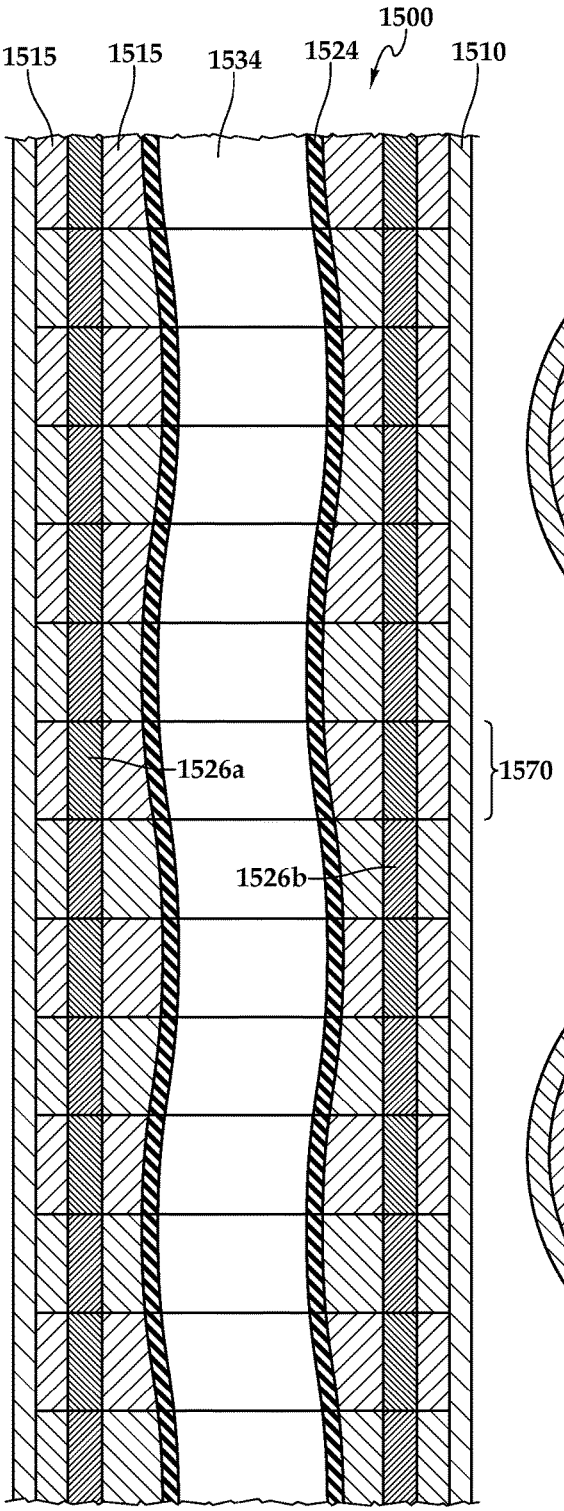
FIG. 9A is a cross-sectional view of an example sectional stator of a downhole drilling motor.
Figure 9B:
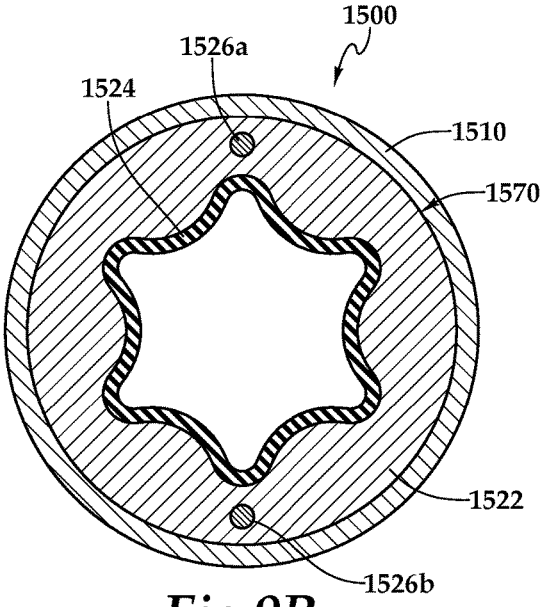
FIG. 9B is an end view of an example stator section.

FIG. 9A is a cross-sectional view of an example sectional stator 1500. The stator 1500 includes a tubular housing 1510 and a collection of stator sections 1570. As shown in FIG. 9B, each stator section 1570 of the stator 1500 includes a metal insert layer 1522. In some embodiments, the insert layer 1522 can be an elastomer layer.

A conductive sub-section 1526*a* and a conductive sub-section 1526*b* are formed within a portion of the insert layer 1522. In some embodiments, the conductive sub-sections 1526*a*, 1526*b* may be electrically conductive sleeves or plugs that are inserted or otherwise applied to sub-sections of the insert layer 1522.

In some embodiments, the insert layer 1522 can provide electrical insulation. For example, the insert layer 1522 may also perform the function of an insulating sub-layer between the conductive sub-sections 1526*a*, 1526*b* and the tubular housing 1510.

Referring again to FIG. 9A, the stator 1500 includes a collection of the stator sections 1570, arranged as a lateral stack or row transverse to the longitudinal axis of the stator 1500 along the interior of the tubular housing 1510. The stator sections 1570 are oriented such that the conductive sub-sections 1526*a*, 1526*b* substantially align and make electrical contact with each other to provide insulated electrically conductive paths along the length of the stator 1500.

In some embodiments, the conductive sub-sections 1526*a*, 1526*b* may be replaced by open, e.g., unfilled, sub-sections. For example, the stator sections 1570 can be oriented such that the open sub-sections substantially align and form a bore along the length of the stator 1500. In some embodiments, one or more conductive wires or laminated conductive sleeves may be passed through the bore formed by the open sub-sections.

Figure 10:
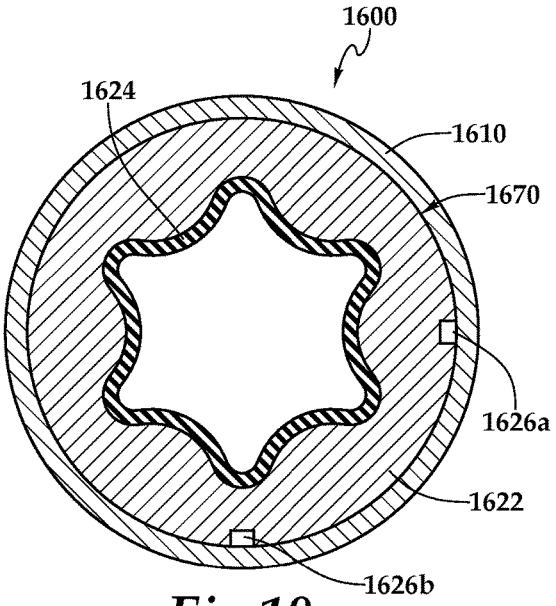
FIG. 10 is an end view of another example stator section.

FIG. 10 is an end view of another example stator section 1670 of an example stator 1600. In some implementations, the stator section 1670 may be used in place of the stator sections 1570 of FIG. 12A. The stator section 1670 includes a metal insert layer 1622. In some embodiments, the insert layer 1622 can be the elastomer layer. In some applications the disc or plate type stacked metal inserts 1622 are steel. They have an internal lobed geometry to which a thin layer of elastomer 1624 is applied. In other implementations, an insulated layer will first be applied to the internal lobed profile of the stacked metal inserts 1622, then there is a conductor layer or strip, then there is a final elastomer layer (the final layer being similar to the currently applied thin elastomer layer on stators).

A conductive sub-section 1626*a* and a conductive sub-section 1626*b* are formed within a portion of the elastomer layer 1622. In some embodiments, the conductive sub-sections 1626*a*, 1626*b* may be electrically conductive sleeves or plugs that are inserted or otherwise applied to sub-sections of the elastomer layer 1622.

In some embodiments, the conductive sub-sections 1626*a*, 1626*b* can include one or more electrically insulating and/or conductive sub-layers. For example the conductive sub-sections 1626*a*, 1626*b* may each include an electrically conductive sub-layer surrounded by an electrically insulating sub-layer, e.g., to prevent the electrically conductive sub-layer from shorting out to the tubular housing 1610. In some embodiments, the conductive sub-sections 1626*a*, 1626*b* may be replaced by open, e.g., unfilled, sub-sections. For example, one or more electrical conductors may be passed through the open subsections to provide an electrical signal path along the length of the stator 1600.

In some implementations, the stators 300, 400, 500, 600, 705, 905, 1005 and/or 1105*a*-1105*f* may be used in conjunction with existing threaded connection conductor couplings, e.g., ring type couplings which fit between a pin connection nose and a box connection bore back upon tubular component assembly, to permit electronic signal and data to travel between components located along a drill string.

Figure 11:
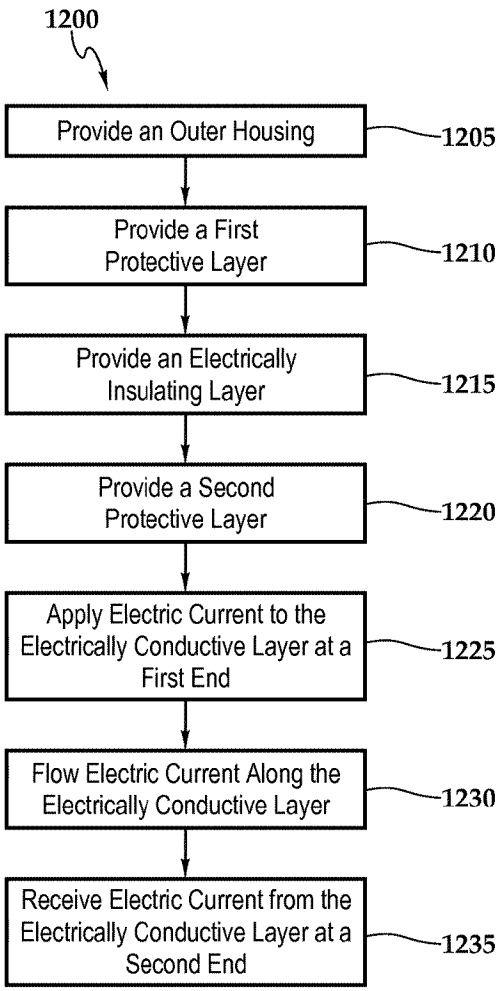
FIG. 11 is a flow diagram of an example process for using a stator that includes an insulated conductor.

FIG. 11 is a flow diagram of an example process 1200 for using a drilling motor stator that includes an insulated conductor. In some implementations, the process 1200 may describe and/or be performed by any of the example stators 300, 400, 500, 600, 705, 905, 1005 and/or 1105*a*-1105*f*. In some implementations, the process 1200 may also describe and/or be performed by the example tubular assembly 600 of FIG. 12 and/or the example tubular assembly 1400 of FIGS. 13*a*-13*b*.

At 1205, an outer housing is provided. For example, in the example of FIGS. 3A to 3F, the tubular housing 310 is provided.

At 1210, a first protective layer is provided. For example, the insulating sub-layer 324*a* is formed as an inwardly concentric layer upon the tubular housing 310.

At 1215, an electrically conductive layer is provided. For example, the conductive sub-layer 322 is formed along the interior surface of the insulating sub-layer 324*a*.

At 1220, a second protective layer is provided. For example, the insulating sub-layer 324*b* is formed as an inwardly concentric layer upon the conductive sub-layer 322.

At 1225, electric current is applied to the electrically conductive layer at a first end. For example, electrical power from the first electrical device 810 is applied to the conductive sub-layer 322 at the first end 830.

At 1230, electric current is flowed along the electrically conductive layer. The electric current may include an electrical signal being transmitted and/or an electrical power being conducted. For example, the first electrical device 810 can provide an electrical signal to the first end 830, and the signal can be transmitted along the conductive sub-layer 322 to the second end 840 or alternatively instead of a signal, electrical power may be conducted through the conductive sub-layer and used to power a device in the tool string (see FIG. 7 and text describing FIG. 7).

At 1235, electric current is received from the electrically conductive layer at a second end. For example, the second electrical device 820 is connected to the conductive sub-layer 322 to receive the signal that has been transmitted from the first electrical device 810 or alternatively receive the electrical power conducted through the conductive layer. It will be appreciated that a signal may be transmitted in either direction through the conductive layer and electrical power may be transmitted in either direction through the conductive layer (see FIG. 7 and text describing FIG. 7).

Figure 12:
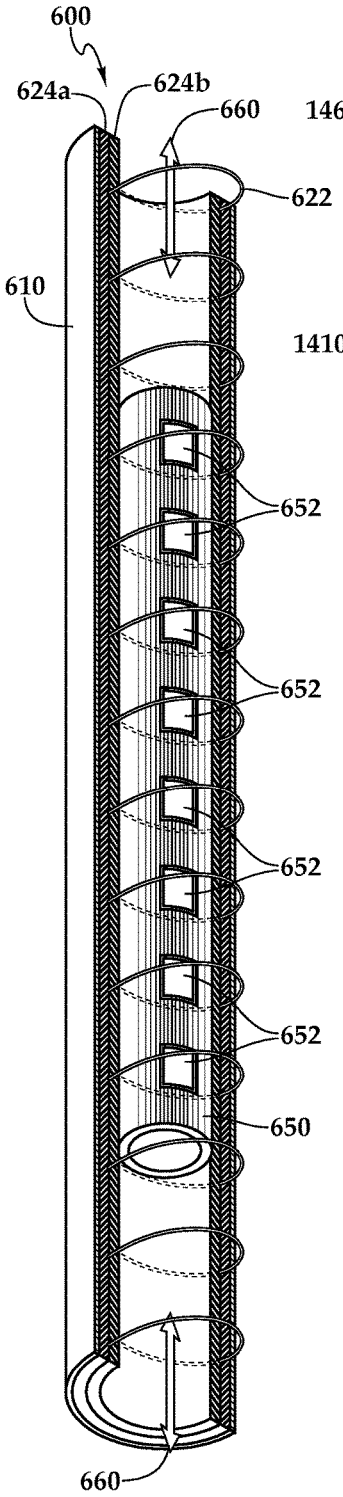
FIG. 12 is a cross-sectional view of another example stator that includes a spiral insulated conductive strip.

FIG. 12 is a cross-sectional view of a tubular assembly 600 that includes a helical, e.g., spirally coiled, insulated conductive strip. In the illustrated example, the tubular assembly 600 includes a tubular housing 610 and a spiral conductive strip layer 622. The conductive sub-layers may be manufactured from various materials including metallics (e.g., copper) and from carbon nano tubes. The geometry of the bore of the tubular housing 1410 may be configured to maximize or optimize the total surface area of the housing bore and therefore optimize the effective surface area of any applied conductive strip. The surface area of the conductive strip is an important factor regarding the current carrying capability or magnetic field production capability of the conductive strip. Although one spiral conductive strip layer is described in this example, in some embodiments, two, three, four, or any other appropriate number of spiral conductive strip layers may be used.

The conductive strip layer 622 is arranged spirally about the longitudinal geometry of the inner surface of the insulating sub-layer 624*a*. The insulating sub-layers may be manufactured from various materials including polymers (including carbon nano tubes) and ceramics. The spiral conductive strip layer 622 is electrically insulated from the tubular housing 610 by the insulating sub-layer 624*a*, and is electrically insulated from the bore of the tubular housing 610 by an insulating sub-layer 624*b*.

The example tubular assembly 600 includes a shaft 650 that includes a collection of magnetic sections 652. The shaft 650 is formed to pass through the bore of the tubular housing 610, and is electrically insulated from the conductive strip layer 622 by the insulating sub-layer 624*b*. The shaft 650 can move longitudinally (e.g., oscillate) along the longitudinal axis of the tubular housing 610 in the directions generally indicated by the arrows 660. In some implementations, the shaft 650 can be moved along the tubular housing 610 to generate electrical current. Alternatively the apparatus used to generate electrical power downhole through the harnessing of the inherently available hydraulic and mechanical power can also be supplied with electrical power, enabling it to function as a downhole mechanical power generation source (e.g., a motor).

In some implementations, drilling fluid energy as applied to a poppet or spool valve as the fluid impinges on it could be harnessed in order to move the shaft 650 longitudinally. In some implementations, a mechanical return device, e.g., a spring or barrel cam device, can provide mechanical resistance, or may be configured to re-set or re-cycle the longitudinal position of the shaft 650. In some implementations, kinetic energy can be harnessed from the application of weight on a downhole tool, such as a drill bit, through longitudinal axis compression in the drill pipe, collars, and/or bottom hole assembly (BHA) components. In some implementations, kinetic energy can be harnessed from application of overpull load on a downhole assembly or tool, such as a reamer, through longitudinal axis tensile loading in the drill pipe, collars, and/or bottom hole assembly (BHA components). In some implementations, shock loading or vibration originating from bit or formation interactions can be harnessed to move the shaft 650 linearly or rotationally.

For example, as the shaft 650 moves within the spiral of the spiral conductive strip layer 622, a magnetic field of one or more of the magnetic sections 652 can induce an electrical current flow along the spiral conductive strip layer 622. In some implementations, electrical current may be passed through the spiral conductive strip layer 622 to move the shaft 650. For example, by controllably electrically energizing and de-energizing the spiral conductive strip layer 622, an electromagnetic field may be generated and that can cause the shaft 650 to linearly move along or reciprocate within the tubular housing 610 to act as a form of linear motor.

Figure 13A:
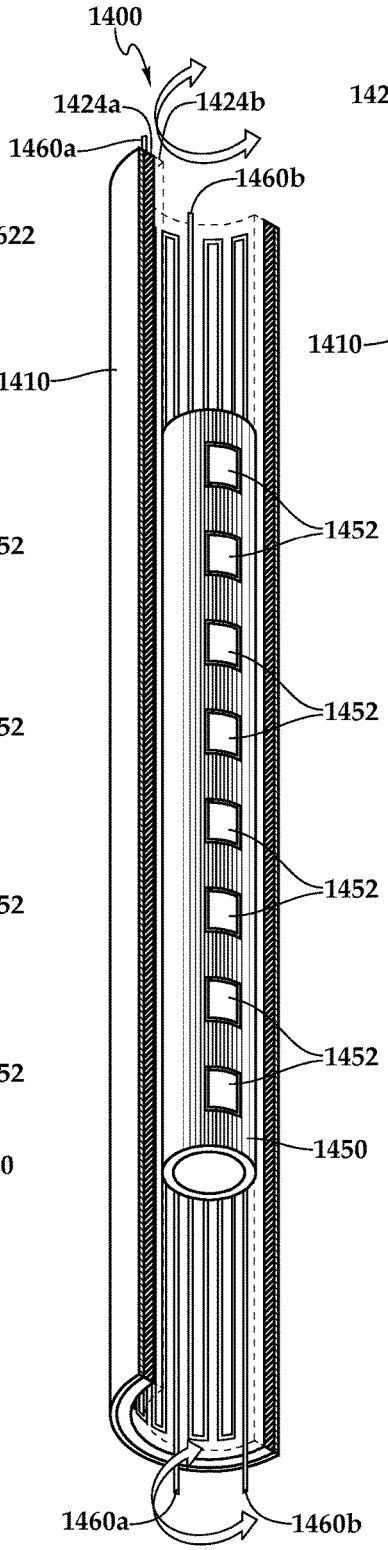
FIGS. 13A and 13B are cross-sectional views of another example stator that includes a collection of serpentine insulated conductive strips.
Figure 13B:
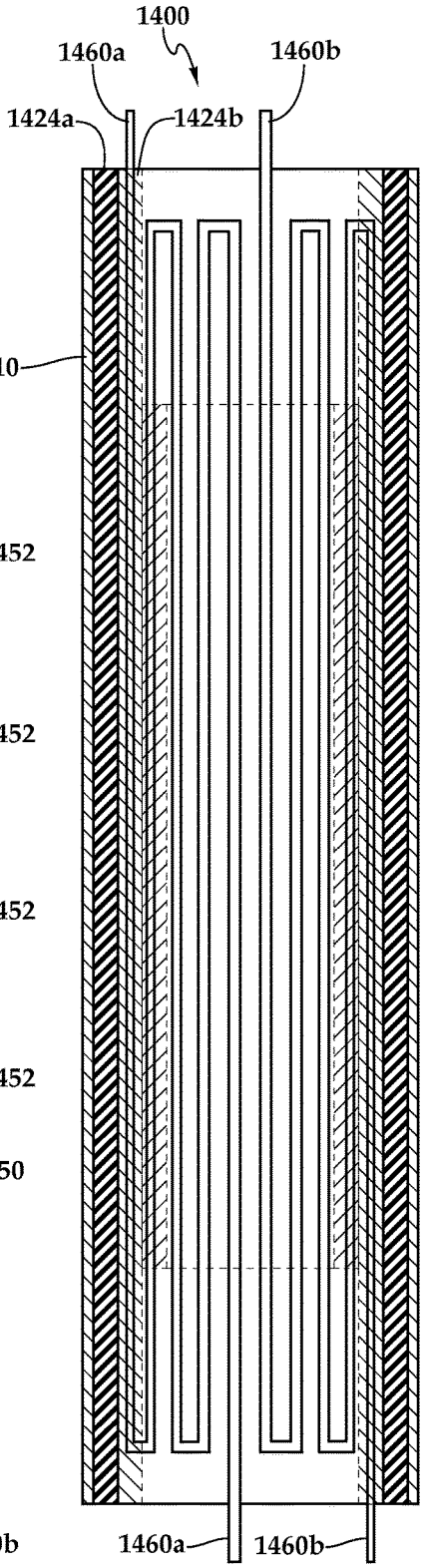

FIGS. 13A and 13B are cross-sectional views of another example tubular assembly 1400 that includes a collection of serpentine, e.g., folded, insulated conductive strips made of materials as previously discussed herein. In the illustrated example, the tubular assembly 1400 includes a tubular housing 1410, a serpentine conductive strip layer 1460*a* and a serpentine conductive strip layer 1460*b*. Although two serpentine conductive strip layers are described in this example, in some embodiments, two, three, four, or any other appropriate number of serpentine conductive strip layers may be used.

The serpentine conductive strip layers 1460*a* and 1460*b* are arranged as electrical paths with periodic turns, such that the majority of the lengths of the serpentine conductive strip layers 1460*a* and 1460*b* lie primarily along longitudinal sections of the inner surface of an insulating sub-layer 1424*a*. The serpentine conductive strip layers 1460*a* and 1460*b* are electrically insulated from the tubular housing 1410 by the insulating sub-layer 1424*a*, and are electrically insulated from the bore of the tubular housing 1410 by an insulating sub-layer 1424*b*. The insulating sub-layers may be manufactured from materials as previously discussed herein.

The example tubular assembly 1400 includes a shaft 1450 that includes a collection of magnetic sections 1452. The shaft 1450 is formed to pass through the bore of the tubular housing 1410, and is electrically insulated from the serpentine conductive strip layers 1460*a* and 1460*b* by the insulating sub-layer 1424*b*. The shaft 1450 can be rotated within the tubular housing 1410 in the directions generally indicated by the illustrated arrows 1490.

In some implementations, the shaft 1450 can be rotated within the stator tubular housing 1410 to generate electrical current. In some implementations, drilling fluid energy as applied by the fluid impinging on a bladed impellor or turbine blade can be harnessed in order to rotate the shaft. For example, kinetic energy could be harnessed from the application of weight on a downhole tool, such as a drill bit, through longitudinal axis compression in the drill pipe, collars, and/or BHA components or from the application of tensile loading on a downhole tool during back reaming operations. In some implementations, shock loading or vibration originating from bit or formation interactions can be harnessed to move the shaft 1450. In some implementations, drill string and/or BHA rotation, acceleration and/or deceleration could be harnessed to move the shaft 1450.

For example, as the shaft 1450 rotates, a magnetic field of one or more of the magnetic sections 1452 can induce an electrical current flow along the serpentine conductive strip layers 1460*a* and 1460*b*. In some implementations, electrical current may be passed through the serpentine conductive strip layers 1460*a* and 1460*b* to move the shaft 1450.

In some implementations, by controllably electrically energizing and de-energizing the serpentine conductive strip layers 1460*a* and 1460*b*, an electromagnetic field may be generated and that can cause the shaft 1450 to rotate in either of two directions or to reciprocate within the stator tubular housing 610, to act as a form of rotary motor.

Figure 14:
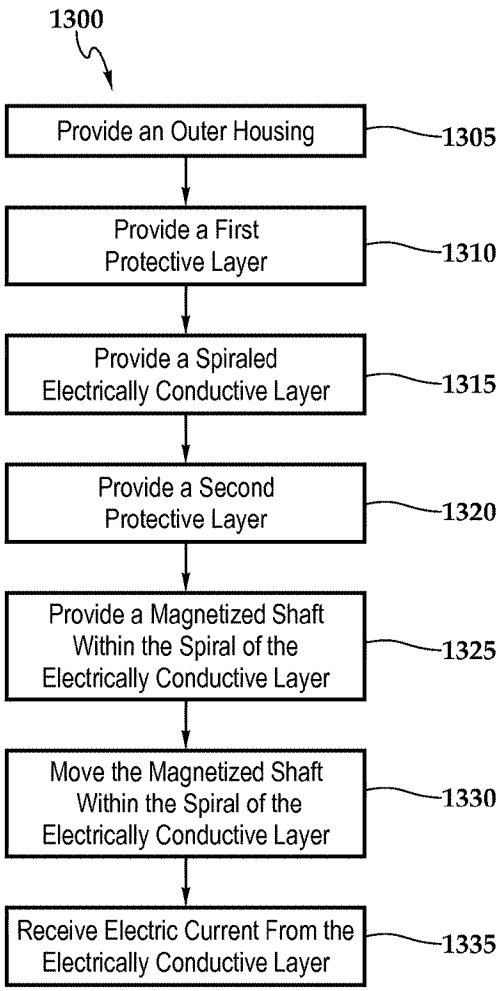
FIG. 14 is a flow diagram of an example process for using a stator that includes a spiraled insulated conductor.

FIG. 14 is a flow diagram of an example process 1300 for using a drilling motor stator that includes a spiraled insulated conductor. In some implementations, the process 1300 may describe and/or be performed by the example tubular assembly 600 of FIG. 12 or the example tubular assembly 1400 of FIGS. 13*a*-13*b*.

At 1305, an outer housing is provided. For example, in the example of FIG. 12, the tubular housing 610 is provided.

At 1310, a first protective layer is provided. For example, the insulating sub-layer 624*a* is formed as an inwardly concentric layer upon the tubular housing 610.

At 1315, an electrically conductive layer is provided. For example, the spiral conductive strip layer 622 is formed along the interior surface of the insulating sub-layer 624*a*.

At 1320, a second protective layer is provided. For example, the insulating sub-layer 624*b* is formed as an inwardly facing layer upon the spiral conductive strip layer 622.

The spiraled electrically conductive layer is coupled at a first end to a first electrical input/output positioned proximal to the first longitudinal end of the outer housing and coupled at a second end to a second electrical input/output positioned proximal to the second longitudinal end of the outer housing. For example, the first electrical device 810 is connected to the conductive sub-layer 324 at a first end 830 of the example stator 300, which could be substituted by the example tubular assembly 600. The second electrical device 820 is connected to the conductive sub-layer 324 at a second end 840.

At 1325, a shaft with magnetic sections is provided within the electrically conductive layer. For example, the magnetic shaft 650 is placed in the bore of the tubular assembly 600, and is electrically insulated from the spiral conductive strip layer 622 by the insulating sub-layer 624*b*.

At 1325, the magnetized shaft is moved within the spiraled electrically conductive layer. For example, the shaft 650 can move longitudinally along the tubular assembly 600 in the directions generally indicated by the arrows 660.

At 1335, electric current is received from the spiraled electrically conductive layer. For example, as the magnetic shaft 650 moves within the spiral conductive strip layer 622, a magnetic field of the magnetic sections 652 can induce an electrical current to flow along the spiral conductive strip layer 622. In some implementations, this electrical current flow can be used to power the first electrical device 810 and/or the second electrical device 820 of FIG. 8.

In some implementations, the process 1300 may be modified to provide mechanical power from the supply of an electrical current flow. For example, at 1330 an electric current may be provided to the electrically conductive layer. Such a current would create an electromagnetic field that would interact with that of the magnetic shaft sections, urging the shaft to move linearly or rotationally, effectively generating mechanical power from electrical power at 1335.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. An electrical generator positionable in a wellbore, the electrical generator comprising:

a tubular housing having a first longitudinal end and a second longitudinal end, said tubular housing having an internal passageway, said passageway having a plurality of layers positioned therein, said layers comprising at least a first protective layer, a second protective layer, and an electrically conductive layer positioned between the first and second protective layers, said layers defining an internal fluid cavity with a longitudinal axis, said electrically conductive layer electrically coupled at a first end to a first electrical end conductor positioned proximal to the first longitudinal end of the tubular housing and electrically coupled at a second end to a second electrical end conductor positioned proximal to the second longitudinal end of the tubular housing, and a shaft with two or more magnetic inserts positioned at different longitudinal locations along a length thereof, said shaft movable longitudinally in the internal fluid cavity of the housing;

wherein the electrically conductive layer comprises one or more conductive strips configured as one or more spirals formed about an inner surface of the tubular housing, the one or more conductive strips configured as one or more spirals positioned proximate the two or more magnetic inserts.

2. The electrical generator of claim 1, wherein the first protective layer is positioned along an inner surface of the tubular housing, the electrically conductive layer is along an inner surface of the first protective layer and the second protective layer is positioned along an inner surface of the electrically conductive layer.

3. The electrical generator of claim 1, wherein at least one of the first protective layer and the second protective layer is electrically non-conductive.

4. The electrical generator of claim 1, wherein the electrically conductive layer comprises a first electrically conductive layer and said generator further comprises a second electrically conductive layer that is electrically insulated from the first electrically conductive layer.

5. The electrical generator of claim 4, wherein the second electrically conductive layer is positioned along an inner surface of the second protective layer, and a third protective layer is positioned along an inner surface of the second electrically conductive layer.

6. The electrical generator of claim 1, wherein the electrically conductive layer is positioned along the inner surface of the first protective layer.

7. The electrical generator of claim 4, wherein the second electrically conductive layer is positioned parallel to the first electrically conductive layer.

8. The electrical generator of claim 1 wherein the first end conductor is in electronic communication with the second end conductor via at least one conductive layer positioned in the tubular housing.

9. The electrical generator of claim 8 wherein an electrical current generated in the conductive layer is received at either the first end or the second end conductor via at least one conductive layer positioned in the tubular housing.

10. The electric generator of claim 1, wherein the two or more magnetic inserts are positioned in general end to end alignment at different longitudinal locations along a length thereof.

11. An electrical generator positionable in a wellbore, the electrical generator comprising:

a tubular housing having a first longitudinal end and a second longitudinal end, said tubular housing having an internal passageway, said passageway having a plurality of layers positioned therein, said layers comprising at least a first protective layer, a second protective layer, and an electrically conductive layer positioned between the first and second protective layers, said layers defining an internal fluid cavity with a longitudinal axis, said electrically conductive layer electrically coupled at a first end to a first electrical end conductor positioned proximal to the first longitudinal end of the tubular housing and electrically coupled at a second end to a second electrical end conductor positioned proximal to the second longitudinal end of the tubular housing; and a shaft with two or more magnetic inserts positioned at different longitudinal locations along a length thereof, said shaft movable longitudinally in the internal fluid cavity of the housing;

wherein the electrically conductive layer comprises one or more conductive strips configured as one or more serpentine paths formed along an inner surface of the tubular housing, the one or more conductive strips configured as one or more serpentine paths positioned proximate the two or more magnetic inserts.

12. A method of generating electricity in a well drilling operation, the method comprising:

positioning an electrical generator in a wellbore, the generator including a tubular housing having a first longitudinal end, a second longitudinal end, said tubular housing having an internal passageway, said passageway having a plurality of layers positioned therein, said layers comprising at least a first protective layer, a second protective layer, and an electrically conductive layer positioned between the first and second protective layers, said layers defining an internal fluid cavity with a longitudinal axis, said electrically conductive layer electrically coupled at a first end to a first electrical end conductor positioned proximal to the first longitudinal end of the tubular housing and electrically coupled at a second end to a second electrical end conductor positioned proximal to the second longitudinal end of the tubular housing, and, a shaft having two or more magnetic inserts positioned at different longitudinal locations along a length thereof, said shaft movably positioned in the internal fluid cavity of the housing;

moving the shaft longitudinally within the electrically conductive layer;

inducing a flow of current in the electrically conductive layer as the two or more magnetic inserts pass thereby; and receiving electric current from the electrically conductive layer at the first electrical end conductor or the second electrical end conductor.

13. The method of claim 12, wherein the electrically conductive layer comprises one or more conductive strips configured as one or more spirals formed about an inner surface of the tubular housing.

14. The method of claim 12, wherein the electrically conductive layer comprises one or more conductive strips configured as one or more serpentine paths formed along an inner surface of the tubular housing.

15. The method of claim 12, wherein moving the shaft longitudinally within the electrically conductive layer comprises vibrational movement of the shaft linearly, resulting from vibrations transmitted from the drill bit interacting with a formation being drilled.

16. The method of claim 12, wherein moving the shaft longitudinally within the electrically conductive layer comprises tensile loading on a drill string coupled to the shaft resulting from upward back reaming operations in the well drilling operations.

17. The method of claim 12, wherein moving the shaft longitudinally within the electrically conductive layer comprises tensile loading on a drill string coupled to the shaft resulting from application of an overpull load on a downhole tool.

18. The method of claim 12, wherein moving the shaft longitudinally within the electrically conductive layer comprises contacting a poppet valve with a drilling fluid and moving a stem in the poppet valve linearly wherein the stem is coupled to the shaft of the generator.

19. The method of claim 12, wherein moving the shaft longitudinally within the electrically conductive layer comprises movement of the shaft in the generator by a re-set spring.

20. The method of claim 12, wherein moving the shaft longitudinally within the electrically conductive layer comprises application of weight to a drill string coupled to the shaft.

* * * * *